US010196962B2

(12) United States Patent
Kerkewitz et al.

(10) Patent No.: US 10,196,962 B2
(45) Date of Patent: Feb. 5, 2019

(54) EXPANSION TANK FOR A COOLANT CIRCUIT OF A MOTOR VEHICLE

(71) Applicant: GM GLOBAL TECHNOLOGY OPERATIONS LLC, Detroit, MI (US)

(72) Inventors: Richard Kerkewitz, Ruesselsheim (DE); Klaus Hofmann, Ruesselsheim (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/610,115

(22) Filed: May 31, 2017

(65) Prior Publication Data

US 2017/0350307 A1 Dec. 7, 2017

(30) Foreign Application Priority Data

Jun. 1, 2016 (DE) ..... 10 2016 006 662

(51) Int. Cl.
*F01P 11/02* (2006.01)

(52) U.S. Cl.
CPC ..... *F01P 11/029* (2013.01)

(58) Field of Classification Search
CPC ..... F01P 11/029; F01P 11/02; F01P 11/028; F01P 11/0285
See application file for complete search history.

(56) References Cited

U.S. PATENT DOCUMENTS

| | | | | |
|---|---|---|---|---|
| 4,739,730 | A | 4/1988 | Jenz et al. | |
| 2007/0235458 | A1 | 10/2007 | Hewkin | |
| 2013/0048643 | A1 | 2/2013 | Flajnik et al. | |
| 2015/0308326 | A1* | 10/2015 | Davies | F01P 11/029 137/2 |

FOREIGN PATENT DOCUMENTS

FR 2822440 A1 9/2002

OTHER PUBLICATIONS

German Patent Office, German Search Report for German Application No. 102016006662.8, dated Mar. 8, 2017.

* cited by examiner

*Primary Examiner* — Jacob Amick
(74) *Attorney, Agent, or Firm* — Lorenz & Kopf, LLP

(57) ABSTRACT

An expansion tank for a coolant circuit of a motor vehicle includes a housing with an upper part with an upper joint and a lower part with a lower joint. An inlet is arranged on the upper part. An outlet is arranged on the lower part. The upper part is connectable by the upper joint to the lower joint of the lower part in at least two different orientations.

20 Claims, 3 Drawing Sheets

EXPANSION TANK FOR A COOLANT CIRCUIT OF A MOTOR VEHICLE

CROSS-REFERENCE TO RELATED APPLICATION

This application claims priority to German Patent Application No. 102016006662.8, filed Jun. 1, 2016, which is incorporated herein by reference in its entirety.

TECHNICAL FIELD

The present disclosure pertains to an expansion tank for a coolant circuit of a motor vehicle that includes a housing with an upper part and a lower part.

BACKGROUND

Conventional motor vehicles with an engine that generates waste heat usually include a coolant circuit, by which the engine, for example an internal combustion engine, can be thermally coupled to at least one heat exchanger, for example a radiator. A coolant such as, for example, cooling water mixed with antifreeze circulates in the coolant circuit.

Conventional coolant circuits include an expansion tank for initially filling the coolant circuit with the coolant, as well as for separating and extracting gas bubbles that are inevitably present in the coolant circuit. This expansion tank typically includes an inlet for the coolant, as well as an outlet for the coolant. In light of the constricted space conditions in the engine compartment of a motor vehicle, such expansion tanks occupy a comparatively large volume that can hardly be reduced due to the functionality of the expansion tank. The accommodation of the expansion tank and its connections, particularly the inlet and the outlet, occasionally has to be individually adapted to different vehicle types.

For a motor vehicle manufacturer, who offers a wide variety of different vehicles and vehicle types on the market, it would therefore be desirable to minimize the manufacturing and tool costs for such expansion tanks, if possible without compromising the flexibility and individual adaptability of expansion tanks to the given geometric requirements in an engine compartment.

SUMMARY

In accordance with the present disclosure an expansion tank is provided for a coolant circuit of a motor vehicle. The expansion tank includes a housing with an upper part and a lower part. An inlet is arranged on the upper part. The upper part is furthermore provided with an upper joint. An outlet is arranged on the lower part. The lower part is furthermore provided with a lower joint. The upper and the lower joint respectively have corresponding or complementary geometries, by which the upper and the lower joint and therefore the housing parts, namely the upper part and the lower part, can be assembled.

The upper part with its upper joint can be connected to the lower joint of the lower part in at least two different orientations. Due to this measure and the mutually adapted geometric design of the upper and the lower joint, at least two different types of expansion tanks can be produced on the basis of only two corresponding housing halves, namely the upper part and the lower part.

In a particular embodiment, the upper part and the lower part can be connected to one another, as well as fixed on one another, in a plurality of different mutual orientations. Since the upper part and the lower part can be connected and fixed in various orientations relative to one another, a corresponding number of differently configured expansion tanks can be produced. These expansion tanks may be configured and individualized in accordance with the respective motor vehicle type, while always including the same upper and lower parts.

The manufacturing and tool costs can be minimized. For example, only one tool such as, e.g., an injection mold is respectively required for the upper part and for the lower part. The upper part and the lower part can be produced separately of one another. A specification and individualization of the expansion tank is exclusively realized with the corresponding assembly of the upper part and the lower part.

According to an enhancement of the expansion tank, the upper part and the lower part form a closed hollow space for accommodating a fluid when they are connected to one another by the upper and the lower joint. For example, the upper part and the lower part may complement one another in such a way that they form a spherical shape in their configuration, in which the respective joints abut on one another. The housing of the expansion tank may insofar have a spherical or ball-shaped geometry.

However, the housing is not limited to a spherical shape. For example, the upper part and/or the lower part may be realized in the form of hemispheres or hemispherical shells. The abutting and interconnected joints are rotationally symmetrical or axially symmetrical. The hollow space formed by the upper part and the lower part is closed or sealed relative to the outside with the exception of any inlet or outlet openings, which are required for the intended use of the expansion tank and its arrangement in the coolant circuit.

The upper part and the lower part and therefore the upper and lower joints thereof have geometric structures and/or geometric shapes that complement one another such that a closed hollow space for accommodating a fluid is formed as a result of a purposeful assembly of the upper part and the lower part. Since the hollow space or the container interior coinciding with the hollow space is respectively formed by the upper part and the lower part, the upper part and the lower part may be respectively realized without undercuts such that they are particularly suitable for being produced by an injection molding process. The upper part and/or the lower part may insofar be realized in the form of injection-molded plastic components that are particularly suitable for rational and cost-effective mass production.

According to another embodiment, the upper and the lower joint are connected to one another in a fluid-tight fashion. A fluid-tight connection between the upper part and the lower part makes it possible to accommodate a liquid, particularly the coolant circulating in the coolant circuit, without any leakage. The fluid-tight connection between the upper and the lower joint may be realized, in particular, in the form of an irreversible connection. The upper and the lower joint may insofar be inseparably connected to one another, i.e. the upper part and the lower part can only be separated from one another by destroying the upper part or the lower part or by destroying at least the upper or the lower joint. A fluid-tight and inseparable connection between the upper and the lower joint is particularly suitable for an expansion tank of a coolant circuit that is subjected to a certain internal pressure during its intended use.

According to another embodiment of the expansion tank, the upper and the lower joint are integrally connected on another, bonded to one another or welded to one another. The upper part is connected to the lower part to one another in a fluid-tight fashion by a thermal welding process. If the upper part and the lower part are realized in the form of injection-molded plastic components, for example, they may be ultrasonically welded or frictionally welded to one another in the region of the upper joint and the lower joint. Welded connections of this type can be realized particularly robust and durable, as well as in a fluid-tight and gas-tight fashion. In comparison with other connections, they can also be produced easily and quickly and at the same time with low or reasonable costs.

According to another embodiment, the upper and the lower joint respectively have a closed geometry referred to a circumference of the upper part or the lower part. The upper joint, as well as the lower joint, may respectively form a circumferential and closed edge of the upper part or the lower part. In this case, the edges of the upper part and the lower part coinciding with the joints are adapted to one another, as well as realized complementary to one another, in such a way that they can be connected in a fluid-tight fashion in at least two different orientations relative to one another, particularly by bonding or welding. A circumferentially closed or continuous geometric design of the upper and lower joints simplifies the realization of at least two different orientations or a plurality of different orientations, in which the upper part and the lower part can be connected to one another.

According to another embodiment, the upper joint forms a lower boundary of the upper part and the lower joint forms an upper boundary of the lower part. In a preassembly configuration, i.e. immediately prior to the connection or assembly of the upper part and the lower part, the upper joint is located on the underside of the upper part. The upper joint particularly points downward. The lower joint forms an upper boundary of the lower part complementary or corresponding thereto. In other words, the lower joint is oriented upward or points upward and faces the upper part.

The upper joint and the lower joint come in direct contact with one another during the course of a connecting process or an assembly of the upper part and the lower part. For example, the upper and the lower joint may in this case also interlock or be provided with corresponding interlocking contours such that the upper part and the lower part can be at least loosely connected to one another, for example, in a precise and self-centering fashion. An inseparable connection between the upper part and the lower part can subsequently be produced, for example, by a bonding or welding process.

Both housing parts, i.e. the upper part and the lower part, may be realized in a shell-like fashion, wherein the surfaces of the upper part and the lower part, which are curved, for example, in a concave fashion, face one another in a preassembly configuration and form the closed hollow space as soon as the upper and the lower joint come in contact with one another.

According to another embodiment of the expansion tank, the upper and the lower joint are invariant with respect to a rotation of the upper part or the lower part about a center point axis in discrete angular increments. The upper and the lower joint may be invariant with respect to any rotational angle and therefore also a continuous rotation about the center point axis. This means that a rotation, for example, of the upper part about a central point axis, which typically extends through the imaginary center point of the upper joint, does not change the contour of the upper joint.

This may likewise apply to the lower part. The upper part and the lower part can therefore be rotated relative to one another about the center point axis, for example, arbitrarily and in discrete increments and therefore arranged in correspondingly different orientations relative to one another without thereby affecting an assembly by the upper and lower joints in any way. The upper part and the lower part may by all means have different geometries or even different partial volumes as long as the upper and lower joints are realized corresponding or complementary to one another or extensively identical to one another.

According to another embodiment, the upper joint and the lower joint have an oval or elliptical shape or a circular shape. If they have an oval shape, at least two different orientations of the upper part and the lower part and therefore of the upper joint and the lower joint relative to one another can conceivably be realized. The long and the short axes of the oval shape respectively coincide in both different orientations. In other words, a basic orientation and an orientation of the upper part relative to the lower part, which is rotated about the center point axis by 180°, can conceivably be realized if the upper and lower joints have an oval shape.

However, if the upper and lower joints have a circular shape, an infinitesimal number of different orientations between the upper part and the lower part can conceivably be realized. Any arbitrary or even continuously changing rotation of the upper part relative to the lower part about the center point axis has no affect whatsoever on the position and the orientation of the respective joint. If the upper and lower joints have a circular geometry, the orientation of the upper part relative to the lower part is infinitely variable.

According to an alternative embodiment, the upper and lower joints have the shape of a regular polygon. For example, the upper and lower joints may be realized in the form of an isosceles triangle, in the form of a square, in the form of a pentagon or a regular hexagon or, if applicable, also in the form of a heptagon or octagon. In a triangular and isosceles design of the upper and lower joints, a total of three different orientations between the upper part and the lower part can conceivably be realized, namely by a respective rotation by 120°.

Furthermore, the expansion tank may be configured with polygonal geometries of the upper and lower joints, which allow at least two different orientations between the upper part and the lower part. For example, if the upper and lower joints have a regular hexagonal geometry, a total of six different orientations between the upper part and the lower part can be realized by respectively rotating the upper part relative to the lower part in discreet increments of 60°. If the upper and lower joints have the shape of a regular polygon, at least the upper part or the lower part may be configured in a hemispherical or dome-shaped fashion.

According to an enhancement of the expansion tank, the upper and the lower joint respectively lie in an imaginary joint plane. The joints, which are typically realized continuously and closed in the circumferential direction, respectively lie in an imaginary plane that simplifies an arrangement of the upper part and the lower part in different orientations. Prior to carrying out a bonding or welding process, for example, the abutting and contacting upper and lower joints of the upper part and the lower part can still be rotated relative to one another about the center point axis until a predefined orientation of the upper part relative to the lower part is reached.

Adjustments of this type can be carried out in a comparatively simple fashion if the upper and the lower joint respectively lie completely within a single imaginary joint plane. The upper part and the lower part can still be rotated relative to one another and correspondingly oriented when they are already in a mutually contacting position.

According to another embodiment of the expansion tank, the upper and the lower joint are symmetrical referred to a geometric center point of the respective joints. For example, the upper and lower joints may be realized point-symmetrical such that the predefined point symmetry allows at least two different orientations, in which the upper part and the lower part or in which the upper joint and the lower joint of the upper part and the lower part can be respectively connected to and fixed on one another in a fluid-tight fashion.

According to another embodiment, the upper and the lower joint are respectively realized mirror-symmetrical referred to a mirror line that extends through the center point and lies in the joint plane. For example, joints of this type may have the shape of a regular polygon, but also an elliptical shape. As soon as the upper and the lower joint meet one of the above-described symmetry criteria, they can typically be connected to one another in at least two different orientations. If applicable, the upper part and the lower part or the upper joint and the lower joint can also be connected to one another in a fluid-tight fashion in other mutual orientations.

According to another embodiment, at least one outwardly protruding mounting element is arranged or integrally formed on at least the upper part or the lower part. The mounting element makes it possible to install the expansion tank, for example, in the engine compartment of a motor vehicle. In this context, multiple mounting elements may be arranged or integrally formed on the upper part or the lower part. The upper part and the lower part respectively may include at least one mounting element or multiple mounting elements.

In an embodiment, the mounting elements are provided on the upper part only; whereas the outlet of the expansion tank is exclusively arranged on the lower part and, if applicable, protrudes from the outer circumference of the lower part. Since various orientations of the upper part relative to the lower part can be realized, for example, the at least one mounting element can be arranged or oriented in a predefined orientation and arrangement relative to the outlet. Consequently, an orientation and arrangement of the at least one mounting element relative to the outlet can simply be changed by the way, in which the upper part and the lower part are assembled and connected to one another.

This likewise applies to a relative orientation and positioning between the outlet and the inlet or to a relative orientation and positioning between the outlet and the filler opening. The inlet and the outlet can be selectively arranged on or protrude from the same side or opposite sides of the expansion tank by simply assembling the upper part and the lower part accordingly.

According to another aspect, an expansion tank set with at least a first and a second expansion tank, if applicable with additional above-described expansion tanks, is proposed. In this case, the first and the second expansion tank are assembled from identical upper parts and lower parts. However, the mutual orientation between the upper part and the lower part of the first expansion tank differs from that of the second expansion tank. For example, if outwardly protruding mounting elements are provided on the upper part only and the outlet provided on the lower part protrudes downward from the lower part, the first expansion tank may be characterized, for example, in that the outlet and the at least one mounting element are arranged on the same side of the expansion tank.

In contrast to the first expansion tank, the mounting element of the second expansion tank may be arranged, for example, on the opposite side of the outlet. In this way, first and second expansion tanks can simply be configured individually and specifically for the respective motor vehicle type due to the ability to position and connect the upper part and the lower part in at least two different orientations relative to one another.

In this respect, the present disclosure proposes a kit for the assembly and production of an expansion tank, which always consists of one and the same upper part and one and the same lower part only. Individually configured expansion tanks, which are adapted to the required geometric dimensions, therefore can simply be produced due to the ability to assemble and connect the upper part and the lower part differently such that particularly the outlet and the inlet are oriented and arranged relative to one another in accordance with the respective intended use.

The present disclosure ultimately also proposes a motor vehicle that includes at least one coolant circuit with an above-described coolant tank.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
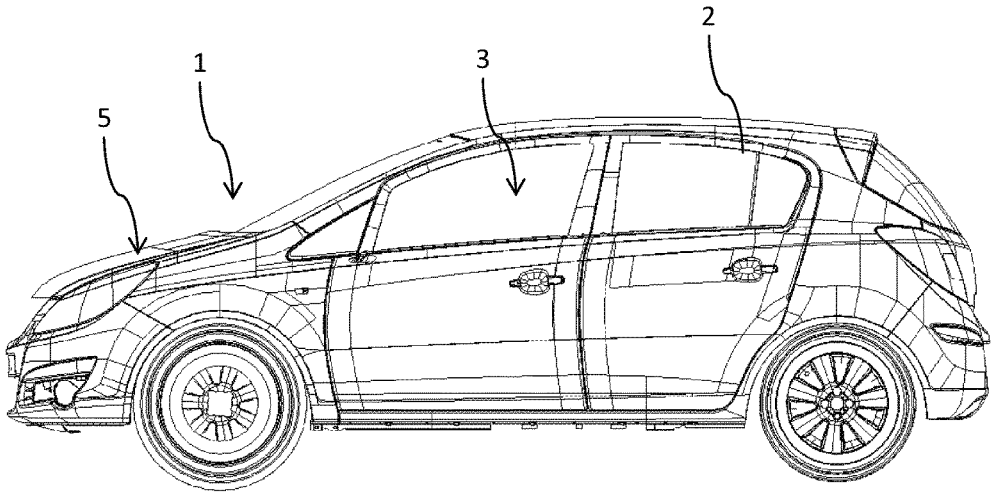
FIG. 1 shows a schematic side view of a motor vehicle.
Figure 2:
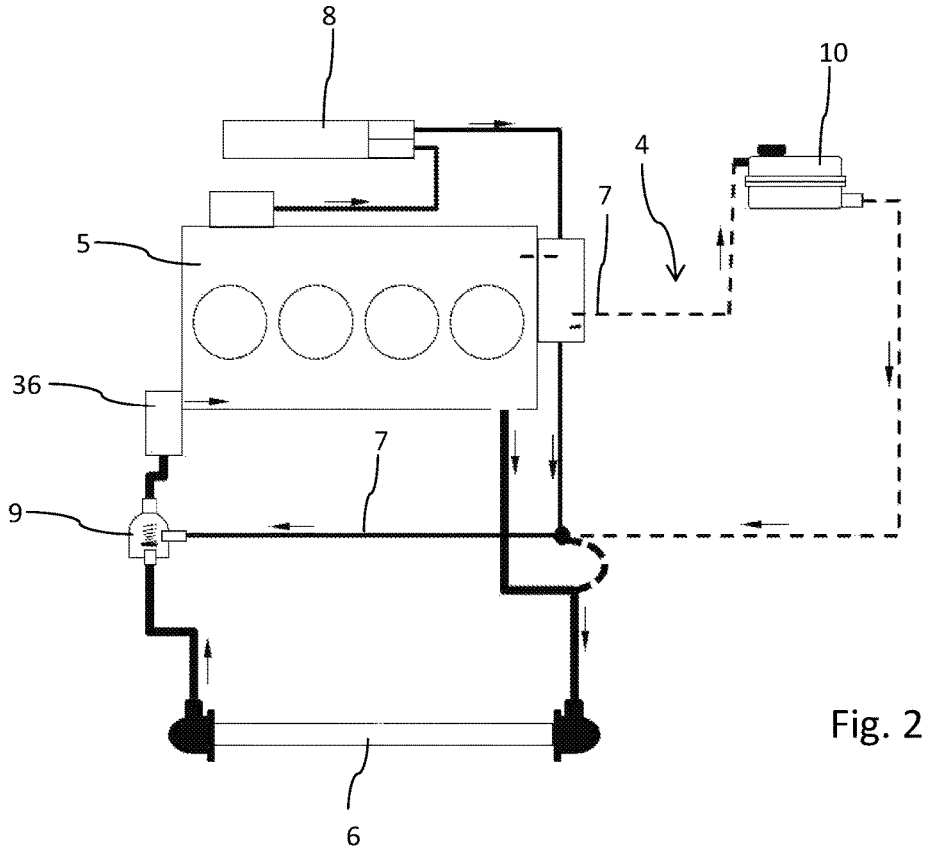
FIG. 2 shows a schematic block diagram of a coolant circuit with an expansion tank.

The motor vehicle 1, which is illustrated in the form of a schematic side view in FIG. 1, includes a vehicle body 2 with an interior 3 that serves as a passenger compartment. The motor vehicle 1 is furthermore provided with an engine in the form of an internal combustion engine 5 that is located underneath a front hood. The engine 5 is thermally coupled to at least one heat exchanger 6 by a coolant circuit 4 that is schematically illustrated in FIG. 2.

The heat exchanger 6 is realized, for example, in the form of a radiator. It is typically arranged behind a radiator grill in the front car body panel. The heat exchanger 6 is thermally coupled to the engine 5 by various coolant lines 7. The coolant circuit 4 furthermore includes a thermostat 9, as well as a heating element 8 that serves for tempering the vehicle interior 3. An expansion tank 10 is arranged in the coolant circuit 4 downstream of the engine 5 and upstream of the thermostat 9, as well as upstream of a pump 36.

Figure 3:
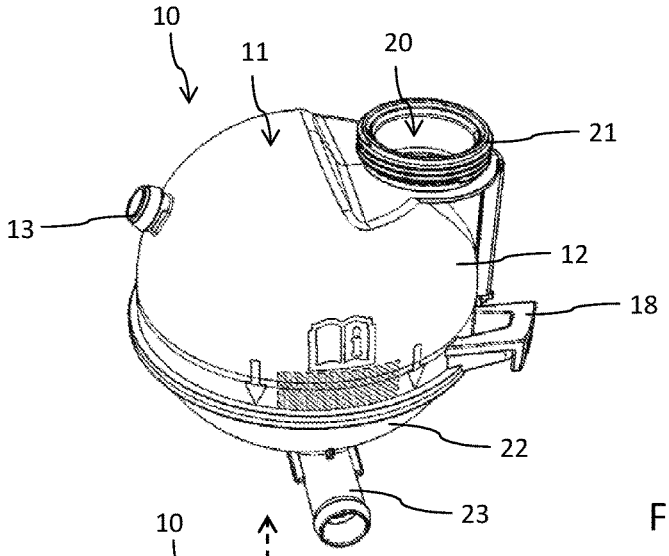
FIG. 3 shows a perspective view of an expansion tank.

The expansion tank 10, which is illustrated in the form of a perspective view in FIG. 3, has an approximately spherical housing 11 with an upper housing part 12 and a lower housing part 22. An inlet 13 is arranged on the upper part 12. An outlet 23 is arranged on the lower part 22. The inlet 13 and the outlet 23 extend radially outward referred to the spherical or radial symmetry of the housing 11. The inlet 13 extends radially outward from a shell-like curved section of the upper part 12 whereas the outlet 23 is presently arranged on a lower end section of the lower part 22, which faces away from the upper part 12. The outlet 23 abuts on the lower part about centrical or radially centrical. It likewise extends radially or tangentially outward.

Figure 5:
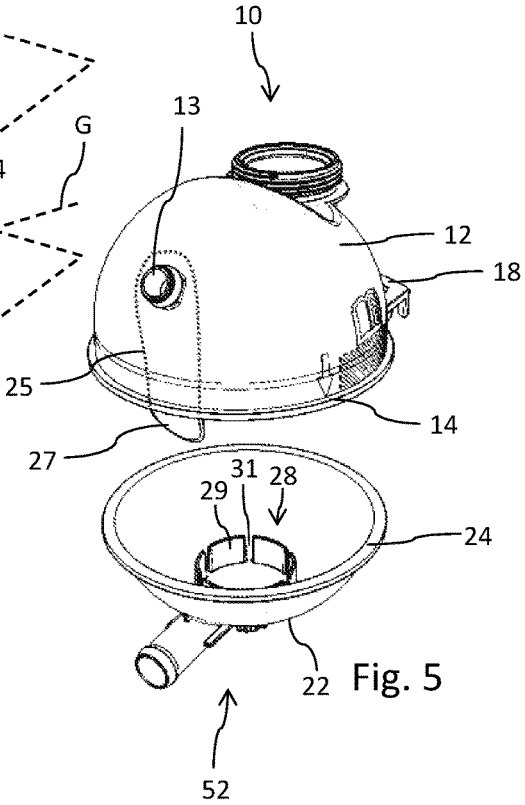
FIG. 5 shows an expanded view of the two housing halves of the expansion tank according to FIG. 3 in another configuration.
Figure 6:
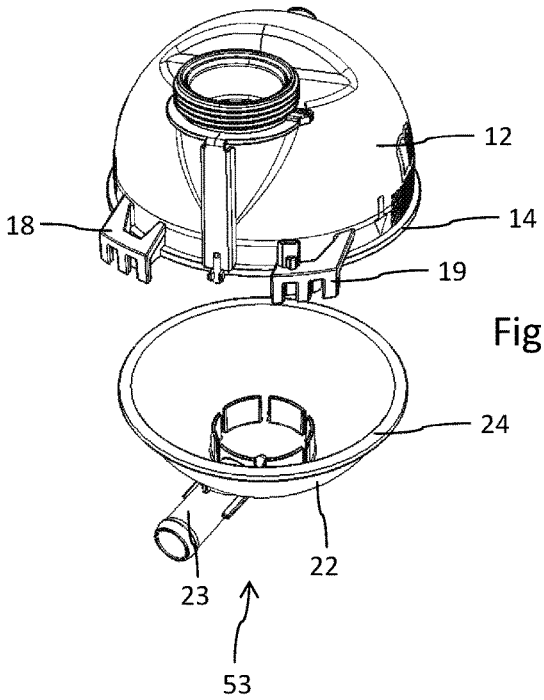
FIG. 6 shows another expanded view of the two housing halves in another orientation.

FIG. 5 furthermore shows that a round collar 28 is arranged on an inner side of the lower part 22 and encloses an outlet opening that is connected to the outlet 23. The collar 28 includes individual webs 29 that are respectively realized in the form of a segment of a circle and separated from one another by slots 31 in the circumferential direction of the collar 28. The slots 31 act as a rake of sorts in order to retain any gas bubbles in the expansion tank 10.

A riser 25 is furthermore arranged on an inner side of the upper part 12 and connects the inlet 13 to the hollow space 15 and to the interior of the expansion tank 10 in the form of a fluidic connection only. Starting from the inlet 13, the riser 25 extends downward and may downwardly protrude from the edge of the upper part 12 formed by the upper housing interface or joint 14. During the operation, an open end 27 of the riser 25, which faces away from the inlet 13, is arranged below a level of the coolant located in the expansion tank.

The end 27 is preferably arranged radially outside the collar 28 in order to improve the degassing of the coolant in the interior of the expansion tank 10. If a suction effect in the coolant circuit 4 is generated at the inlet 13, the riser 25 exclusively draws liquid coolant into the coolant circuit.

As an alternative to the illustrated arrangement of the riser 25 and the collar 28, the riser may protrude into the hollow space 15 formed by the upper part 12 and the lower part 22 from above in a radially centrical or radially central fashion whereas the outlet 23 is fluidically connected to one or more outlet openings arranged radially outside the collar 28.

In the embodiment shown, the upper part 12 furthermore includes a closable filler opening 20. This filler opening is provided with an external thread 21 in the embodiment shown. It can be closed in a gas-tight and fluid-tight fashion by a screw cap that is not explicitly illustrated. The inlet 13 and the outlet 23 are realized in the form of fluid-conveying connection pieces that protrude from the housing 11 of the expansion tank 10 and can be respectively connected to a hose or to a coolant line 7 of the coolant circuit 4 in a fluid-conveying fashion. In the assembled state, the upper part 12 and the lower part 22 form an extensively closed hollow space 15.

According to FIGS. 4-7, the upper part 12 furthermore includes two mounting elements 18, 19 that extend radially outward approximately parallel to one another. These mounting elements serve for mounting the expansion tank 10 on the vehicle body 2.

The coolant can be initially introduced into the coolant circuit 4 through the filler opening 20. The expansion tank 10 is in accordance with its intended use only partially or incompletely filled with the coolant circulating in the coolant circuit 4. An upper part of expansion tank 10 is free of liquid. The expansion tank 10 insofar serves for a gas-liquid separation in the coolant circuit. Any gas bubbles that reach the expansion tank 10 through the inlet 13 remain in the expansion tank 10 and accumulate in the interior thereof, i.e. in the hollow space 15, whereas the coolant accumulating on the bottom of the expansion tank 10 once again flows back into the coolant circuit 4 through the outlet 23 largely free of gas bubbles.

With respect to the production and assembly technology, an upper housing interface or joint 14 and a lower housing interface or joint 24 are respectively provided for the upper part 12 and for the lower part 22. The upper joint 14 is located on a lower edge or lower end of the upper part 12 that faces the lower part 22. The lower joint 24 is accordingly located on the upper edge of the lower part 22 that faces the upper part 12. The upper joint 14 and the lower joint 24 are realized corresponding or complementary to one another, namely in such a way that the upper part 12 and the lower part 22 can be connected to one another and permanently fixed relative to one another in at least two different orientations.

The different orientations 51, 52, 53, 54 of the upper part 12 and the lower part 22 are illustrated in the form of perspective views in FIGS. 4-7. According to FIGS. 4-7, the lower part 22 is always oriented identically whereas the upper part 12 is successively rotated about a center point axis 17. The center point axis represents an axis of symmetry of the dome-like or spherical shell-like upper part 12. The downwardly directed upper joint 14 is located on an imaginary joint plane 16. This also applies to the lower joint 24, which is located completely in or on an imaginary joint plane 26.

In the final assembly configuration according to FIG. 2, both joint planes 16, 26 essentially coincide. The two joint planes 16, 26 essentially extend parallel to one another in all illustrations according to FIGS. 4-7, in which the upper part 12 is in comparison with its final assembly position according to FIG. 13 respectively offset relative to the lower part 22 in the longitudinal direction of the center point axis 17. In this case, the center point axis 17 extends about perpendicular to the imaginary joint planes 16, 26.

In the exemplary embodiment according to FIGS. 3-7, both the upper and the lower joint 14, 24 are respectively realized circular and in the form of lower and upper lateral edges of the upper part 12 and the lower part 22. The joints 14, 24 are insofar essentially invariant with respect to a rotation of the upper part 12 and the lower part 22 about the center point axis 17.

The upper part 12 and the lower part 22 can be connected to and fixed on one another in any orientation referred to the center point axis 17. For example, the orientation 51 according to FIG. 4 can be changed to the orientation 52 according to FIG. 5 by rotating the upper part 12 about the center point axis 17 in the clockwise direction by approximately 90°. An additional rotation of the upper part 12 about the center point axis 17 in the clockwise direction by approximately 135° leads to the configuration or mutual orientation 53 of the upper part 12 and the lower part 22 according to FIG. 6.

Figure 7:
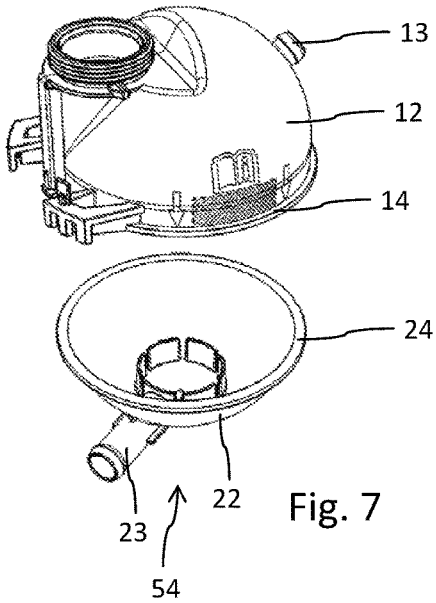
FIG. 7 shows a perspective view of the two housing halves in another orientation.

For example, an additional rotation of the upper part 12 about the center point axis in the clockwise direction by approximately 45° leads to another orientation 54 that is illustrated in FIG. 7. The upper part 12 and the lower part 22 can be connected to one another by the corresponding joints 14, 24, which are respectively realized approximately circular, in each of the orientations 51, 52, 53, 54 shown. The joints 14, 24 may be engaged with one another in an interlocking fashion, for example, by being clipped to one another. The upper part 12 and the lower part 22 can be ultimately connected to and fixed on one another by a bonding or welding process. The upper part 12 may be permanently connected to the lower part 22 to one another by ultrasonic welding or similar plastic welding processes.

Figure 8:
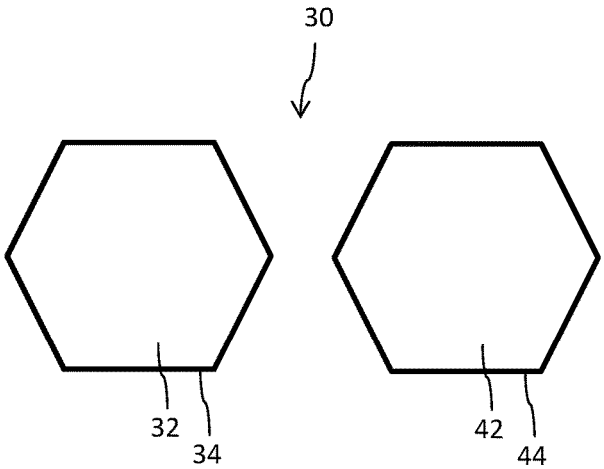
FIG. 8 shows a schematic representation of an upper part and a lower part with respective hexagonal joints.

In the embodiment of an expansion tank 30 illustrated in FIG. 8, the parts to be connected to one another, namely an upper part 32 and a lower part 42, are merely indicated schematically. The upper part 32 and the lower part 42 may also have a spherical dome-like geometry or shape in this case. Instead of a circular joint 14, 24 of the type illustrated in FIGS. 3-7, the upper part 32 includes a hexagonal upper joint 34. The lower part 42 accordingly includes a hexagonal lower joint 44. In this case, the upper part 32 and the lower part 42 can in accordance with the hexagonal geometry be connected to one another in at least six different orientations. The upper part 32 and the lower part 42 can be arranged on and connected to one another in six different yet discreet orientations relative to one another.

Figure 4:
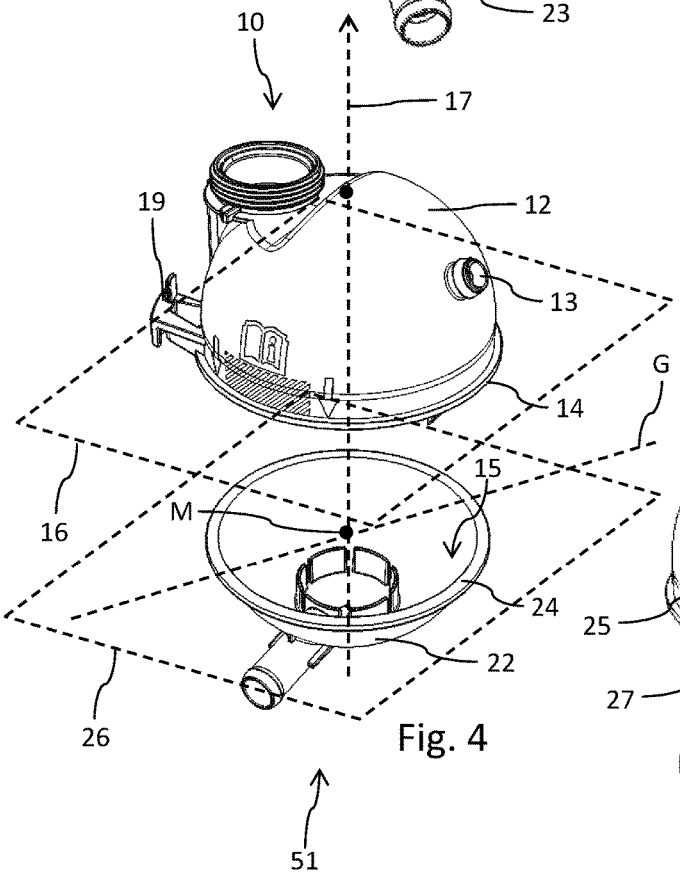
FIG. 4 shows an expanded view of the expansion tank in a first configuration.

As an example, FIG. 4 furthermore shows the geometric center point M of the lower joint 24 of the lower part 22. In this case, the geometric center point M coincides with the center point of the circular lower joint 24. A mirror line G is also illustrated in FIG. 4. This mirror line typically lies in the joint plane 26 and extends through the geometric center point M such that it divides the circular lower joint 24 into two equally large semicircles in the present exemplary embodiment.

Regardless of the illustrated geometric designs of the upper parts 12, 32 and lower parts 22, 42 and of the upper joints 14, 34 and lower joints 24, 44 provided thereon, the upper parts 12, 32 and the lower parts 22, 42 can be respectively connected to one another in at least two different orientations. Various mutual arrangements and orientations of the connections that protrude outward from the housing 11 of the expansion tank 10, 30, e.g. the inlet 13, the 23 and the filler opening 20, can conceivably be realized in accordance with the mutual orientation of the upper part 12 and the lower part 22, as well as the upper part 32 and the lower part 42.

The variety of mutual arrangements between the upper part 12, 32 and the lower part 22, 42 makes it possible to individually adapt the expansion tank 10 and its housing 11 to various structural space requirements and space conditions, for example, in the engine compartment of a motor vehicle 1.

In order to produce various expansion tanks 10 of the type illustrated, for example, in the form of first, second, third or fourth expansion tanks in FIGS. 4-7, it is merely required to always assemble and permanently connect one and the same upper part 12 to one and the same lower part 22 in different mutual orientations 51, 52, 53, 54. At least two of the different expansion tanks 10, 30 illustrated in FIGS. 4-7 or in FIG. 8 may form an expansion tank set. The number of tools required for the production of the upper part 12 and the lower part 22 can thereby be reduced to a minimum. Many different expansion tanks 10 can be produced with a small number of identical parts, for example with always one and the same upper part 12 and one and the same lower part 22.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. An expansion tank for a single coolant circuit in a motor vehicle, the expansion tank having a plurality of configurations, the expansion tank comprising:

a first housing part having a first housing interface;

an inlet formed in the first housing part, the inlet extending along an inlet axis;

a second housing part having a second housing interface;

an outlet formed in the second housing part, the outlet extending along an outlet axis;

wherein the first housing interface and the second housing interface are connectable in a first orientation to provide a first geometric configuration for the expansion tank and in a second orientation to provide a second geometric configuration for the expansion tank;

the inlet axis disposed in a first position relative to the outlet axis in the first orientation, the inlet axis disposed in a second position relative to the outlet axis in the second orientation;

the first housing part and the second housing part cooperatively defining a closed hollow space configured for a fluid to flow in a downstream direction from the inlet, through the hollow space, and to the outlet; and the outlet being the only outlet from the closed hollow space in the downstream direction.

2. The expansion tank according to claim 1, wherein the first and second housing interfaces are connected to one another in a fluid-tight fashion.

3. The expansion tank according to claim 2, wherein the first and second housing interfaces are integrally connected to one another.

4. The expansion tank according to claim 1, wherein the first and second housing interfaces comprise a closed geometry referred to a circumference of the first housing part and the second housing part.

5. The expansion tank according to claim 1, wherein the first housing interface forms a first boundary of the first housing part and the second housing interface forms a second boundary of the second housing part.

6. The expansion tank according to claim 1, wherein the first and second housing interfaces are invariant with respect to a rotation about a center point axis of at least one of the first housing part or the second housing part.

7. The expansion tank according to claim 6, wherein the first and second housing interfaces comprise an oval shape.

8. The expansion tank according to claim 6, wherein the first and second housing interfaces comprise a circular shape.

9. The expansion tank according to claim 1, wherein a shape of the first and second housing interfaces comprise a regular polygon.

10. The expansion tank according to claim 1, wherein the first and second housing interfaces respectively lie in an imaginary joint plane.

11. The expansion tank according to claim 10, wherein the first and second housing interfaces are symmetrical relative to a geometric center point of the respective housing interfaces.

12. The expansion tank according to claim 11, wherein the first and second housing interfaces are respectively mirror-symmetrical relative to a mirror line extending through a center point and lies in the imaginary joint plane.

13. The expansion tank according to claim 1, further comprising at least one mounting element extending outwardly from at least one of the first housing part and the second housing part.

14. An expansion tank set comprising a first and second expansion tanks according to claim 1, wherein the first and the second expansion tank are assembled from identical first housing parts and second housing parts, and wherein the mutual orientation between the first housing part and the second housing part of the first expansion tank differs from that of the second expansion tank.

15. The expansion tank of claim 1, wherein the outlet axis extends tangential to the second housing part.

16. An expansion tank for a single coolant circuit in a motor vehicle, the expansion tank having a plurality of configurations, the expansion tank comprising:

a first housing part having a first housing interface;

an inlet formed in the first housing part, the inlet extending along an inlet axis;

a second housing part having a second housing interface; and an outlet formed in the second housing part, the outlet extending along an outlet axis;

the first housing interface connected to the second housing interface at one of a plurality of rotational orientations about a center axis that extends through both the first housing part and the second housing part;

the first housing part and the second housing part cooperatively defining a spherical outer surface and a closed hollow interior space of the expansion tank;

the interior space configured for a fluid to flow in a downstream direction from the inlet, through the interior space, and to the outlet;

the first and second housing interfaces connected at different ones of the plurality of rotational orientations for different ones of the plurality of configurations of the expansion tank;

the inlet axis being disposed in different positions relative to the outlet axis in different ones of the plurality of configurations of the expansion tank;

the inlet axis extending radially from the spherical outer surface;

the outlet axis extending tangentially from the spherical outer surface; and the outlet being the only outlet from the closed hollow space in the downstream direction.

17. The expansion tank according to claim 16, wherein the first and second housing interfaces respectively lie in an imaginary joint plane; and wherein the first and second housing interfaces are symmetrical relative to the center axis.

18. The expansion tank according to claim 17, wherein the first and second housing interfaces are integrally connected to one another.

19. The expansion tank according to claim 17, wherein the first and second housing interfaces are hexagonal.

20. The expansion tank according to claim 1, further comprising at least one mounting element extending outwardly from at least one of the first housing part and the second housing part.

* * * * *